US007071825B2

(12) United States Patent
VoBa

(10) Patent No.: US 7,071,825 B2
(45) Date of Patent: Jul. 4, 2006

(54) SELF-MONITORED ACTIVE RACK

(75) Inventor: Son VoBa, Redmond, WA (US)

(73) Assignee: Microsoft Corporation, Redmond, WA (US)

( * ) Notice: Subject to any disclaimer, the term of this patent is extended or adjusted under 35 U.S.C. 154(b) by 149 days.

(21) Appl. No.: 10/832,076

(22) Filed: Apr. 26, 2004

(65) Prior Publication Data

US 2005/0237194 A1 Oct. 27, 2005

(51) Int. Cl.
*G08B 13/14* (2006.01)

(52) U.S. Cl. ..... 340/572.1; 340/572.4; 340/539.1; 340/568.1; 340/568.8; 340/825.49; 340/825.69

(58) Field of Classification Search ..... 340/572.1, 340/539.21, 539.23, 568.1, 568.8, 505, 10.1, 340/825.49, 825.69, 572.3, 572.4, 539.1; 235/380, 383, 385; 705/22, 23, 28
See application file for complete search history.

(56) References Cited

U.S. PATENT DOCUMENTS 5,963,134 A * 10/1999 Bowers et al. ..... 340/572.1
5,973,598 A * 10/1999 Beigel ..... 340/572.1
6,891,469 B1 * 5/2005 Engellenner ..... 340/505
6,909,356 B1 * 6/2005 Brown et al. ..... 340/5.2

OTHER PUBLICATIONS

Cosier, G., et al. "Reconnecting Bits and Atoms," *BT Technology Journal,* Vol. 19, Issue 4, Oct. 2001, Abstract.
Rekimoto, Jun, et al., "Data Tiles: A Modular Platform for Mixed PHysical and Graphical Interactions," *Proceedings of the SIGCHI conference on human factors in computing systems,* vol. No. 3, Issue No. 1, Mar. 2001, pp. 269-276.

* cited by examiner

*Primary Examiner*—Hung Nguyen
(74) *Attorney, Agent, or Firm*—Woodcock Washburn LLP

(57) ABSTRACT

A radio frequency identification (RFID) tag is used to detect the presence and identification of devices or equipment in a rack. Each device in the rack has an associated RFID tag that contains device information. The system which is implemented in the rack receives the information from the RFID tag on each device in the rack and provides the information to a central location, such as a central computer, where that information can be acted on, stored, processed, analyzed, and/or accessed by a system administrator or user, for example. The system that is implemented in the rack may continue to monitor the presence of the devices in the rack for security purposes.

18 Claims, 8 Drawing Sheets

SELF-MONITORED ACTIVE RACK

FIELD OF THE INVENTION

This invention relates in general to the field of radio frequency identification (RFID) tags. More particularly, this invention relates to the use of RFID tags to establish the presence and identification of devices in a rack.

BACKGROUND OF THE INVENTION

Radio frequency identification (RFID) transponders or tags are well known and come in a wide variety of shapes and sizes. They can be as small as a pencil lead in diameter and one-half inch in length. They can be credit card shaped for combined use with barcode visual inspection applications. RFID tags can also be used for inventory and security purposes. For example, the anti-theft hard plastic tags attached to merchandise in stores are RFID tags.

RFID tags are categorized as either active or passive. Active RFID tags are powered by an internal battery and are typically read/write, i.e., tag data can be rewritten and/or modified, and typically last up to about four years. However, active tags are less desirable in many applications due to their cost, size, and longevity limitations.

Passive RFID tags operate without a separate external power source and obtain operating power from a reader. Passive tags are consequently much lighter than active tags, less expensive, and offer a virtually unlimited operational lifetime. Read-only tags are typically passive and generally are manufactured with a globally unique set of data (usually 32 to 128 bits) that cannot be modified.

RFID-based designs provide for noncontact, non-line-of-sight sensing. Tags can be employed by a vendor for different purposes during the entire life-cycle of the equipment, from manufacturing to distribution to sales to deployment to services and finally disposal. Tags can be employed by the customers for a wide range of purposes as well, including site capacity planning, asset management, and protection.

Determining the presence and identification of devices in a rack is desirable. Existing methods rely upon a user connecting a computer or other reading device to each of the devices in the rack individually, and requesting and retrieving the device information from each device individually. Thus, to retrieve the information from each of the devices in a rack is a large and burdensome undertaking. Furthermore, existing methods rely upon the device being powered and continually transmitting, using various communications protocols over a wired or wireless connection, an indicator of its presence at the prescribed physical location.

In view of the foregoing, there is a need for systems and methods that overcome the limitations and drawbacks of the prior art.

SUMMARY OF THE INVENTION

The present invention is directed to the use of a radio frequency identification (RFID) tag to determine the presence and identification of devices or equipment in a rack. Each device in the rack has an associated RFID tag that contains device information. The system which is implemented in the rack receives the information from the RFID tag on each device in the rack and provides the information to a central location, such as a central computer, where that information can be acted on, stored, processed, analyzed, and/or accessed by a system administrator or user, for example. The system that is implemented in the rack continues to monitor the presence of the devices in the rack for security purposes, for example.

Exemplary embodiments include systems and methods for determining the presence of a device, comprising an RFID tag disposed on the device, and a rack for receiving the device. The rack comprises an antenna adapted to transmit interrogation signals to the RFID tag, and receive presence signals from the RFID tag, and a "pod" (presence and occupancy discovery) unit comprising an RF interrogator and an RF controller. The pod unit is adapted to receive and decode the presence signals from the antenna, and to determine the presence of the device based on the decoded presence signals.

According to aspects of the invention, the rack is capable of receiving multiple devices, and the antenna is disposed along the height of the rack to transmit interrogation signals to each of the devices. Alternately, the antenna comprises multiple antennae, each of the antennae corresponding to an associated one of the devices to transmit interrogation signals individually to each of the devices.

According to further aspects of the invention, the pod unit monitors the presence of the device by directing interrogation signals to be transmitted via the antenna at predetermined times and confirming detection of received presence signals from the device. If a presence signal is not received from the device, the pod unit starts a timer, and if the timer elapses before another presence signal is received from the device, an indicator is activated, an absence entry is logged in storage, and/or a warning signal is provided to a central controller.

Additional features and advantages of the invention will be made apparent from the following detailed description of illustrative embodiments that proceeds with reference to the accompanying drawings.

BRIEF DESCRIPTION OF THE DRAWINGS

The foregoing summary, as well as the following detailed description of preferred embodiments, is better understood when read in conjunction with the appended drawings. For the purpose of illustrating the invention, there is shown in the drawings exemplary constructions of the invention; however, the invention is not limited to the specific methods and instrumentalities disclosed. In the drawings.

DETAILED DESCRIPTION OF PREFERRED EMBODIMENTS

The present invention determines presence and identification of devices in a rack using radio frequency identification (RFID) wireless technology. Preferably, an RFID controller/reader is comprised within the rack and used in conjunction with a controller and/or a computer. A rack uses RFID to detect, classify, identify, and monitor the presence of servers and/or other rack-mountable devices (such as information technology, or IT, rack-mount devices) without requiring these devices to be powered on or an operator's manual intervention.

The data pertaining to each of the devices in a rack is determined based on information stored in an RFID tag provided on each tag, without turning on the device or connecting a computer to it. Thus, the device does not have to be powered on to be detected, identified, and/or monitored. Desirably, the device manufacturer provides the data into the RFID tag during the manufacture of the device.

When the devices are installed into the rack, the system retrieves information about the devices from the associated RFID tags, and provides the information to a central computer or system administrator. Alternatively, the system can access a database or other storage device to get additional detailed information about each device. The rack then continues to monitor the presence of the devices.

Figure 1:
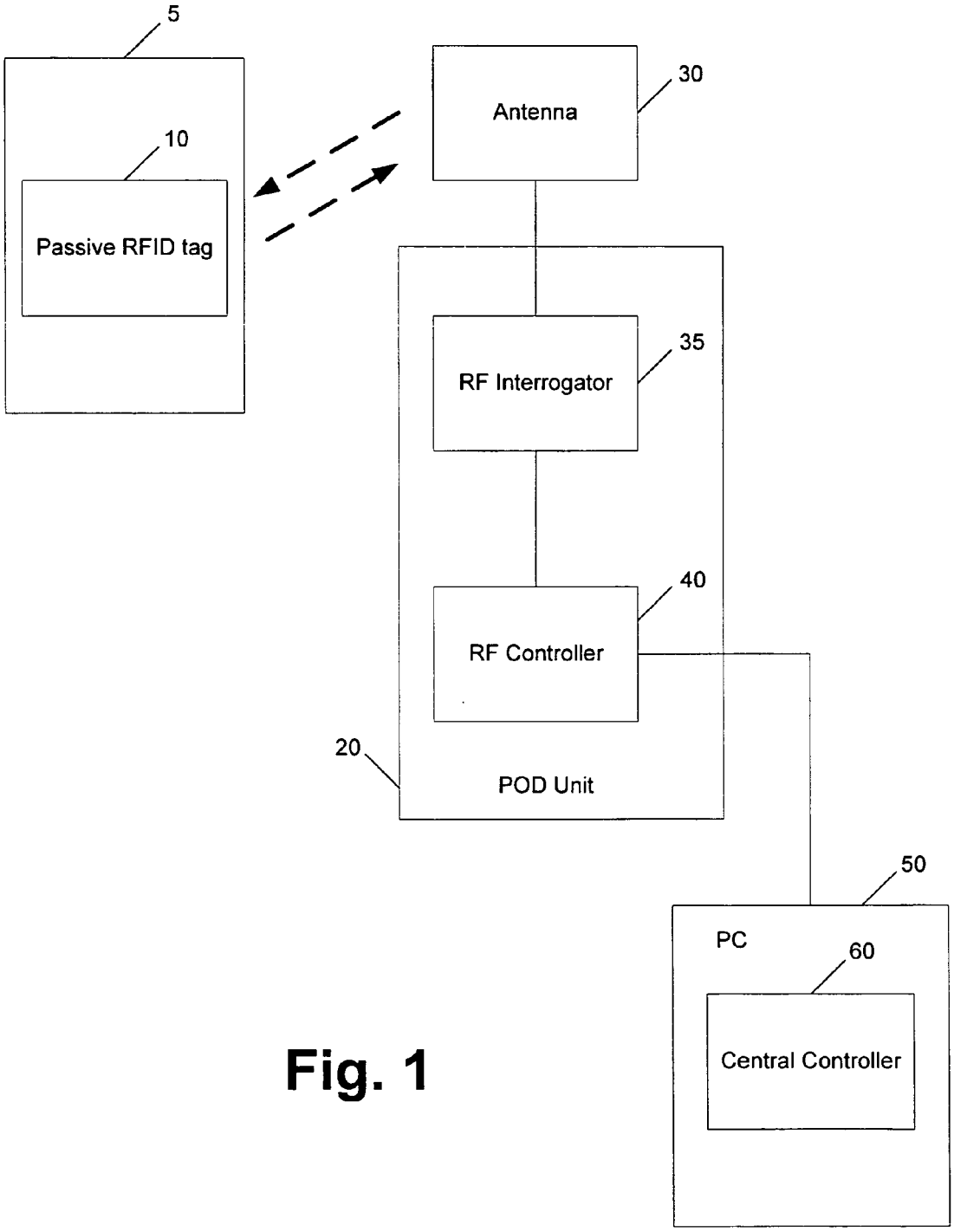
FIG. 1 is a block diagram of an exemplary system in accordance with the present invention.

FIG. 1 is a block diagram of an exemplary RFID system in accordance with the present invention. An RF controller 40, which may be under control of a central controller 60, directs an RF interrogator 35 to search for the presence of an RFID transponder (referred to herein as an RFID tag) 10 by sending signals through an antenna 30. A "pod" (presence and occupancy discovery) unit 20 desirably comprises the RF controller 40 and the RF interrogator 35. The central controller 60 may reside in a personal computer 50 or any other computing device that may act as a host. The central controller 60 may be connected to the POD unit via wired or wireless technologies, e.g., over a network.

The RFID tag 10 is preferably disposed on the device or piece of equipment 5 that will be placed in the rack and subsequently detected, identified, and monitored. Such equipment includes IT rack-mount equipment. The RFID tag 10 is electronically programmed with unique information and affixed to the server or equipment to be installed in the rack. The RFID tag 10 is preferably a passive device that does not require a battery and contains integrated non-volatile memory that allows data to be written to and read from the tag. The tag can be programmed with the information either at installation or before installation (e.g., at a factory during manufacture). The information that can be programmed on the tag includes, for example, an identifier, and/or data about the device 5 to which the tag 10 is attached, such as serial number, manufacturer, and/or information about where to access or otherwise retrieve further data about the device, for example. It is contemplated that the tag 10 can be an active RFID tag instead of the passive RFID tag that is described herein with respect to the various embodiments.

In accordance with the present invention, the tag 10 is used to signal the presence of a device 5 in a rack to the RF controller 40 (via the RF interrogator 35 and the antenna 30), and ultimately the controller 60 or other location, such as a central server, if desired. The RF interrogator 35 generates an interrogatory signal and transmits this signal through the antenna 30 to the surrounding area. The antenna 30, as described in further detail below, may comprise a single antenna or multiple antennae and can be any type of appropriate antenna, such as an omnidirectional antenna. The antenna, e.g., a copper antenna, is desirably disposed within the exterior frame of the rack. The antenna emits radio signals to activate the tag and to the read/write data embedded within the tag. The antenna is the conduit between the tag and the transceiver (i.e., the pod unit), which controls the system's data acquisition and communication. The electromagnetic field produced by the antenna can be constantly present or pulsed at a given interval, such as every three seconds.

Preferably, the RF interrogator 35 interrogates the surrounding area (via the antenna 30) for an RFID tag or tags a predetermined (and preferably programmable) number of times per a predetermined (and preferably programmable) period. For example, the surrounding area could be interrogated approximately 1 time per three seconds. It is desirable that the antenna 30 and RF interrogator 35 can record a target RFID tag 10 at a range of about three feet, though the range can be changed according to suit a user's desires and the dimensions of the rack being used. Characteristics that can be modified to affect the range include the interrogatory signal power level of the RF interrogator 35, the presence signal power level of the RFID tag 10, the detection threshold of the RF interrogator 35, and the characteristics of the antenna 30.

A presence signal from the RFID tag 10 is received by the antenna 30 and provided to the RFID controller 40 via the RFID interrogator 35. A microprocessor (within the controller 40 or separate from the controller 40) including decoder features, for example, can then act on the received signal to generate an appropriate output signal. This output signal can be provided via wired or wireless technologies to a remote computer (comprising central controller 60, for example), as described in further detail below.

Figure 2:
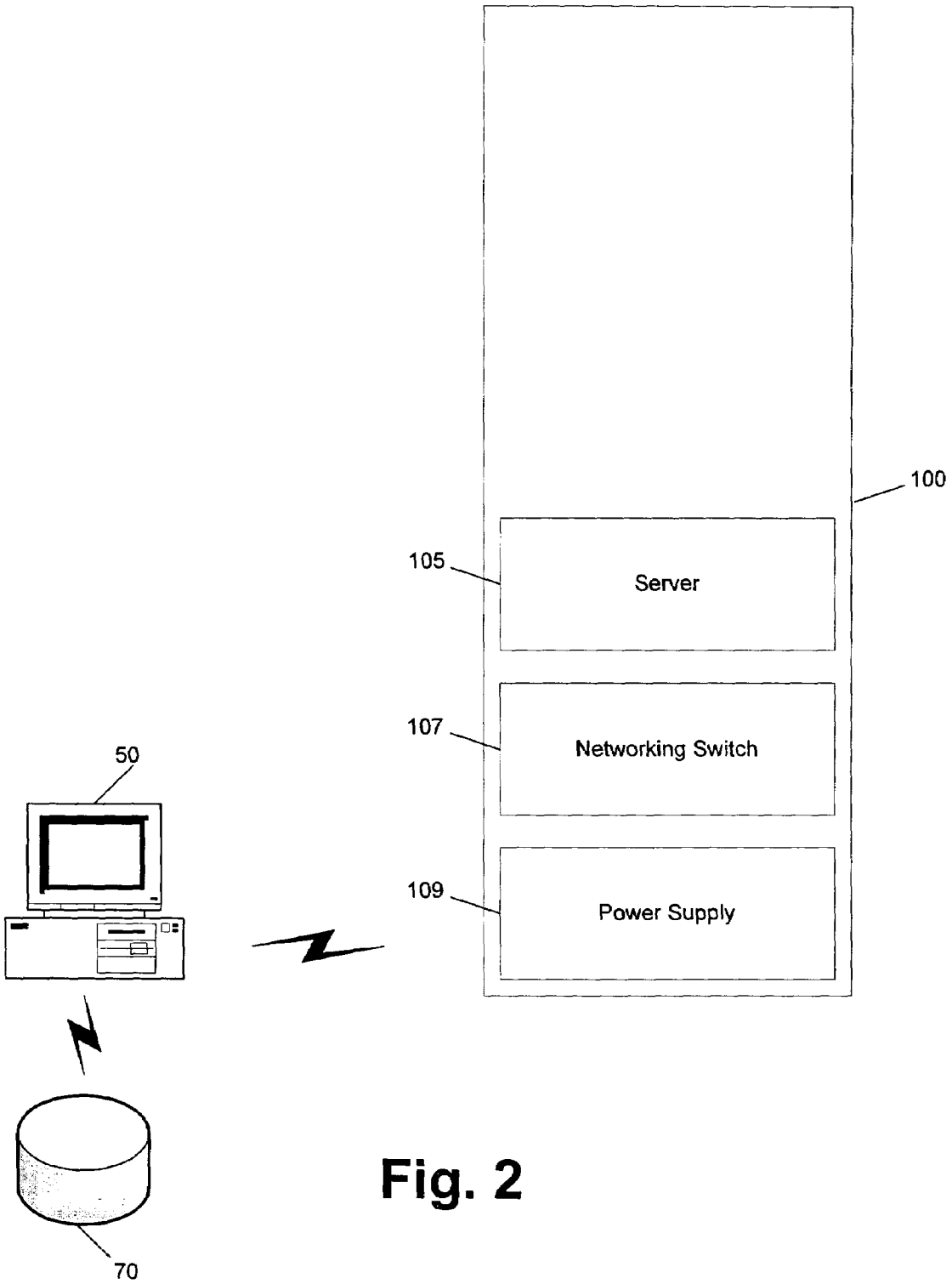
FIG. 2 is a block diagram of a front view of an exemplary rack system in accordance with the present invention.
Figure 3:
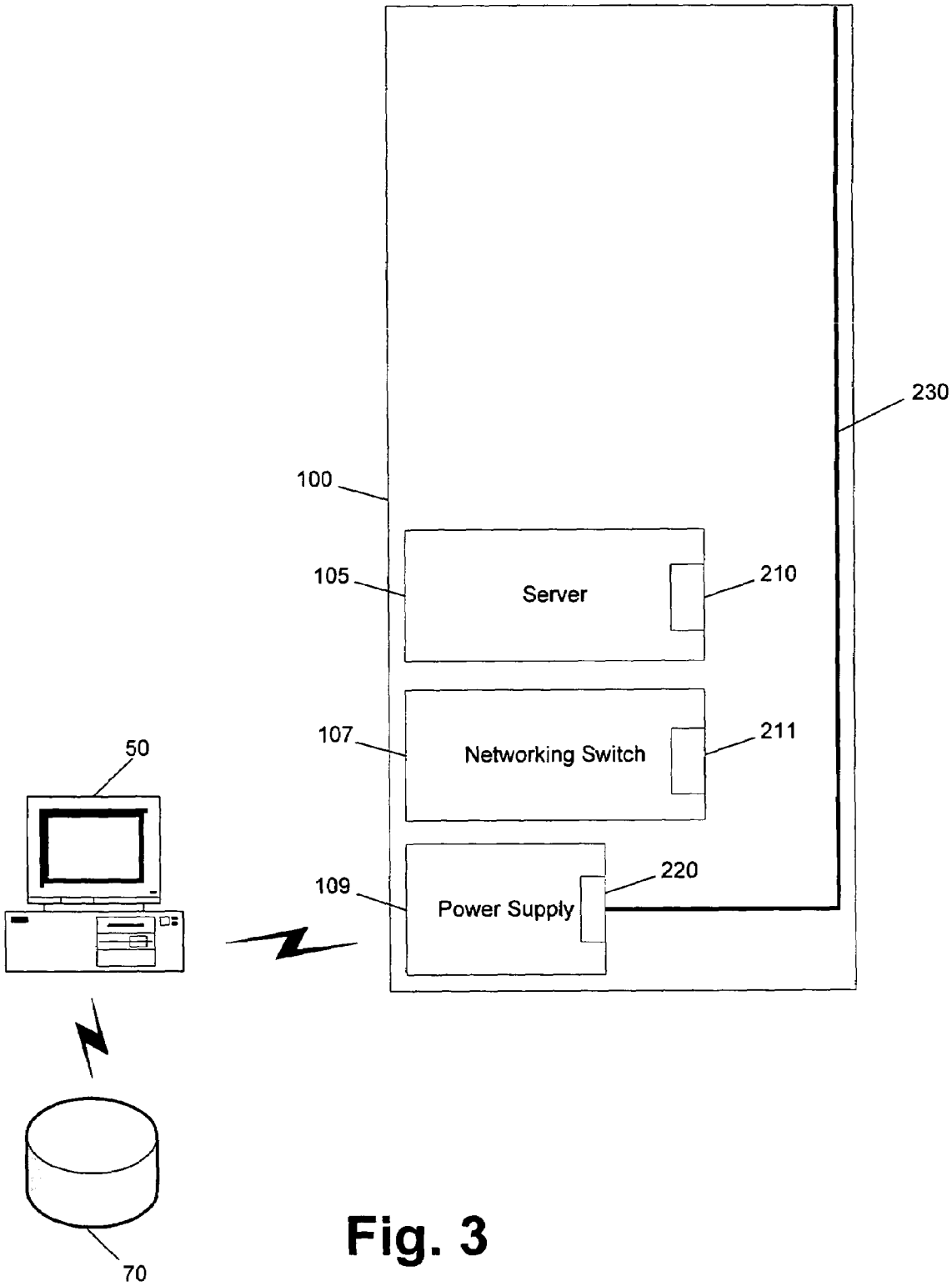
FIG. 3 is a block diagram of a side view of an exemplary rack system with a first exemplary antenna in accordance with the present invention.

FIG. 2 is a block diagram of a front view of an exemplary rack system in accordance with the present invention, and FIG. 3 is a block diagram of an associated side view with an exemplary first antenna. A rack 100 holds multiple devices, such as a server 105 and a networking switch 107, and a power supply 109. These devices are provided as examples, and it is contemplated that any number of devices or pieces of equipment, as well as any type of devices or pieces of equipment, can be provided into the rack 100.

The presence and occupancy discovery unit 220, inside rack 100, is connected by either wired or wireless technologies to a computer, such as the PC 50, which comprises the central controller 60. It is contemplated that any device, and not only the PC 50, can be used to house the central controller 60. This host computer can be an integrated controller of the rack chassis, or a remote system elsewhere in the datacenter.

As shown, the PC 50 may also have access to the storage device 70. The storage device 70 may reside locally or remotely, and be accessible by a network connection, for example. The storage device 70 may contain supplemental device information that is requested after the devices in the rack 100 are identified. Each of the devices to be detected, identified, and monitored preferably has associated disposed or embedded RFID tags. For example, the server 105 has an RFID tag 210 and the networking switch 107 has an RFID tag 211, as shown in FIG. 3. The RFID tags 210, 211 contain information sufficient to identify their associated devices 105, 107 upon being interrogated.

Desirably, a pod unit 220 is incorporated or otherwise connected to a power supply 109. As noted above with respect to FIG. 1, the pod unit desirably comprises a controller and interrogator. The pod unit 220 determines the devices that are present on the rack 100 and can provide this information upstream, e.g., to the central controller 60. It is contemplated that the power supply 109 is a smart power supply.

As shown in FIG. 3, an antenna 230 is provided to broadcast interrogation signals to the various RFID tags and receive presence signals in return. According to an embodiment, the antenna 230 is disposed within the exterior frame of the rack 100. Moreover, the pod unit 220 may be integrated into the frame of the rack 100. For example, the antenna 230 may be packaged with the pod unit 220 to become a reader (i.e., interrogator) which can be configured as a fixed-mount device within the rack 100. The interrogator emits radio waves within a certain range, e.g., up to three feet. When a tag comes within the electromagnetic zone, the tag detects the interrogator's activation signal and provides a presence signal. The controller in the pod unit 220 decodes the data in the received presence signal. This decoded data may be passed to a host computer (e.g., the PC 50) for further processing.

There desirably is no metallic interference between the antenna 230 and the RFID tag on each device. Because the antenna 230 is within the exterior frame of the rack 100, the rack 100 concentrates or otherwise focuses or limits the RF interrogator from sending signals to, and detecting, other external RFID tags (e.g., RFID tags residing on devices or equipment elsewhere in the vicinity, such as on other racks).

The pod unit 220 preferably is able to detect multiple RFID tags, either simultaneously or sequentially. This allows multiple devices in a rack to have their presence and identification established.

It is desirable to determine the presence and identification of a device in a rack, ad to provide that information to a real-time client. The real-time client may then act on the information. In this way, a user, such as a system administrator can easily identify and maintain records of the devices in a rack.

Figure 4:
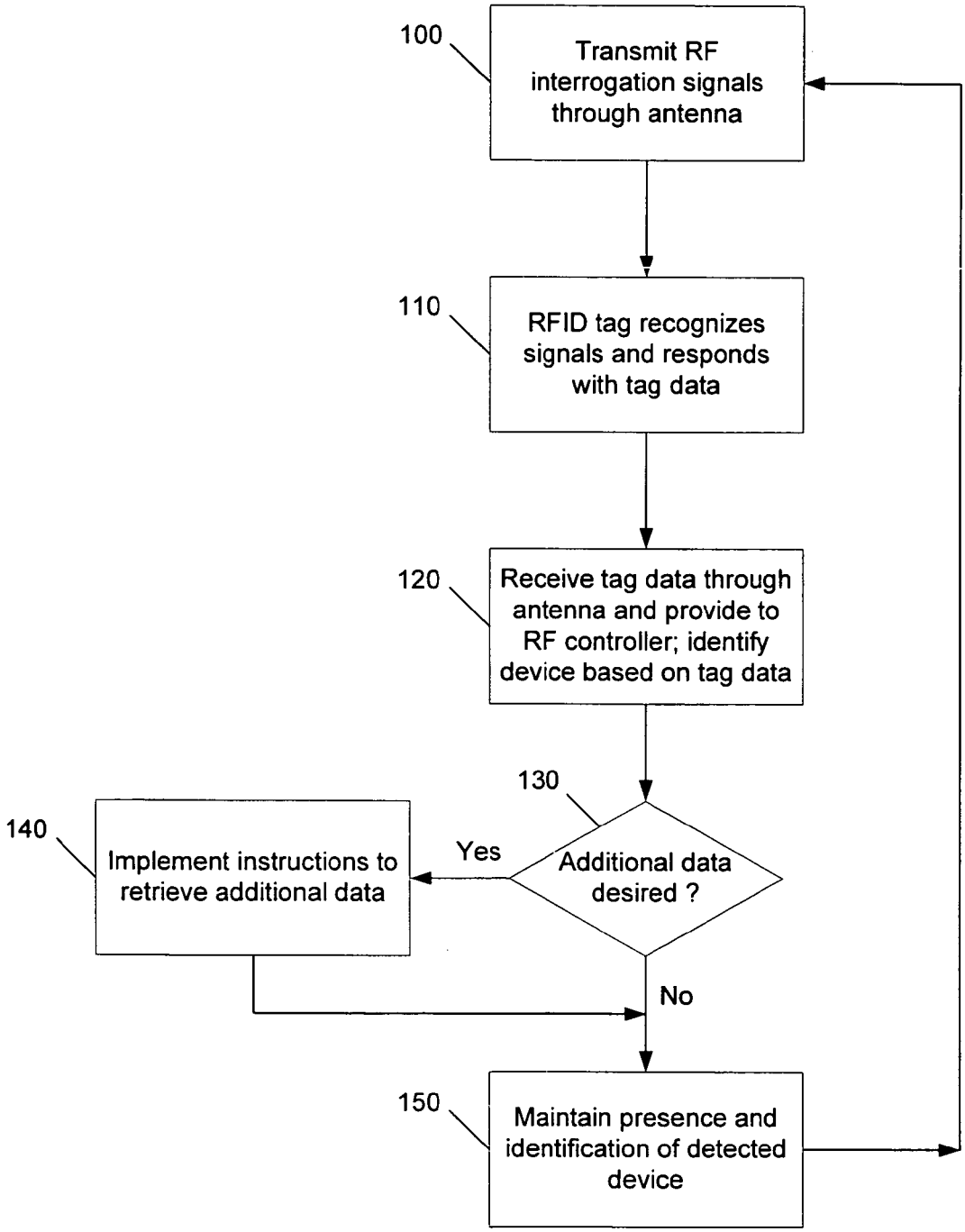
FIG. 4 is a flow diagram of an exemplary method of detecting the presence and determining the identification of devices in a rack in accordance with the present invention.

FIG. 4 is a flow diagram of an exemplary method of detecting the presence and determining the identification of devices in a rack, such as that described with respect to FIG. 3, in accordance with the present invention.

The antenna (e.g., element 30 in FIG. 1 or element 230 in FIG. 3) broadcasts interrogating signals, at step 100. The electromagnetic field produced by the antenna can be constantly present or pulsed at a given interval, such as every three seconds. The RFID tag (which is desirably passive, but may be active) associated with the device being detected recognizes the interrogating signals and responds with a presence signal, at step 110.

The presence signal preferably comprises data that identifies the device. According to an example, the tag data is divided into three fields, each is 32-bit in length. The tag data could have identification fields such as "vendor ID", "device ID", "product-specific data", and "serial number". Other information can be included such as the physical characteristics of the server and its power consumption. This schema can be customized. It is contemplated that to ensure the uniqueness of the identification fields across the industry, the vendor ID's will be issued by a clearinghouse authority. It is contemplated that the device ID's will be issued by the product vendors according to a particular format or standard.

The RFID controller 40 receives the tag data (via the antenna 30 and the RFID interrogator 35 in FIG. 1) and decodes it, if desired, at step 120. The tag data may be complete, or additional data may be desired, at step 130. It may be determined that additional data is desired based on the received tag data containing instructions or locally stored instructions or a combination.

If it is determined that additional data is desired, then the central controller 60 implements the instructions for further retrieval, at step 140. For example, at step 140, pursuant to the instructions, the central controller 60, for example, accesses a database or other storage device 70, either locally or remote (e.g., via the internet), to retrieve the additional data. For example, the serial number of the device may be provided to the device manufacturer's website which would in turn provide the additional desired data.

More particularly, the PC 50 acts upon the information contained within the received RFID tag data, either directly (e.g., the information contains instructions) or by accessing a storage device and looking up predetermined rules or instructions associated with the received RFID tag data. Lookup tables or other data storage and retrieval techniques may be implemented to associate RFID tag data with system control instructions. The presence and identification is then provided, displayed, stored, and/or otherwise maintained, at step 150. Processing continues at step 100.

Figure 5:
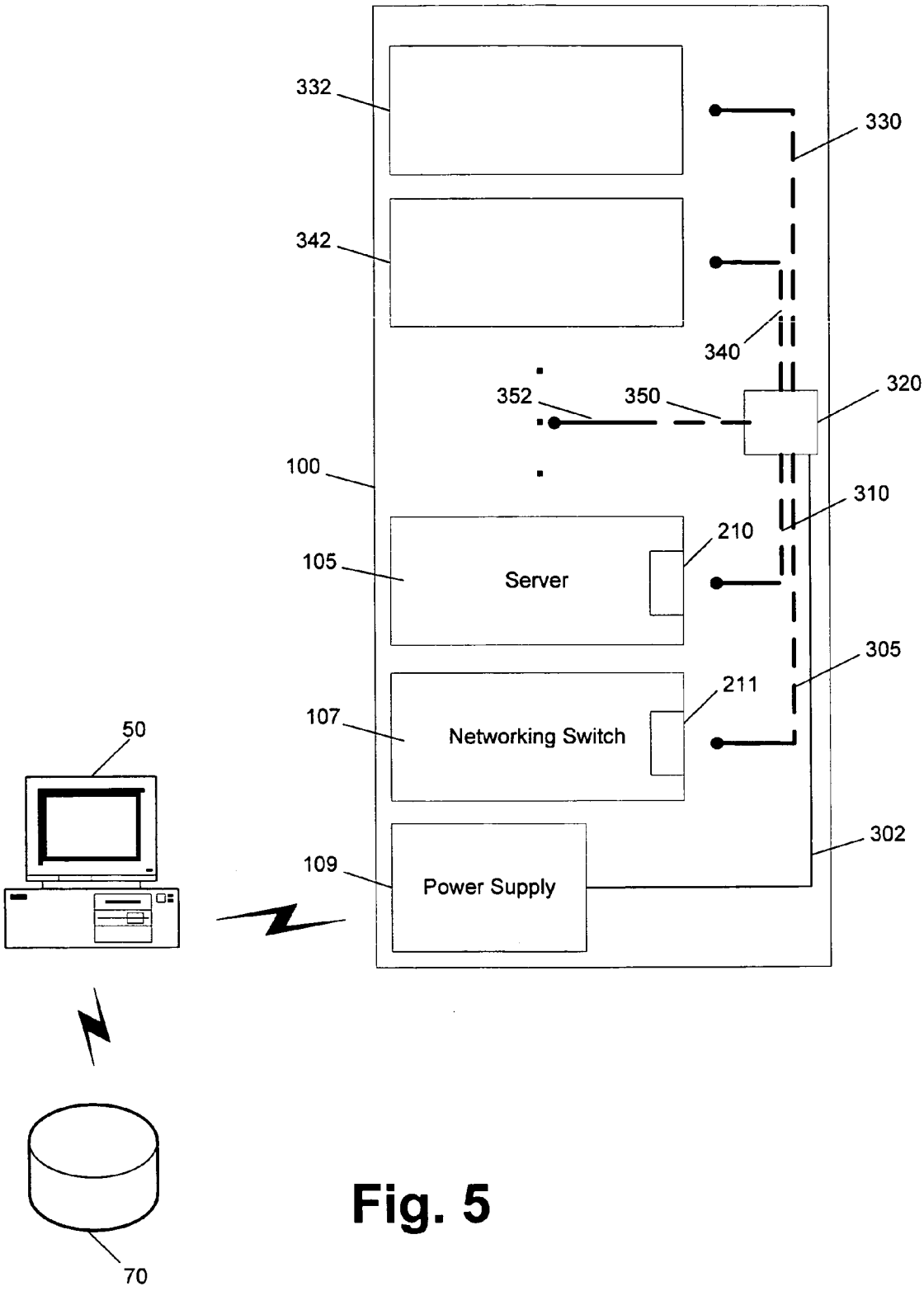
FIG. 5 is a block diagram of a side view of an exemplary rack system with another exemplary antenna in accordance with the present invention.
Figure 6:
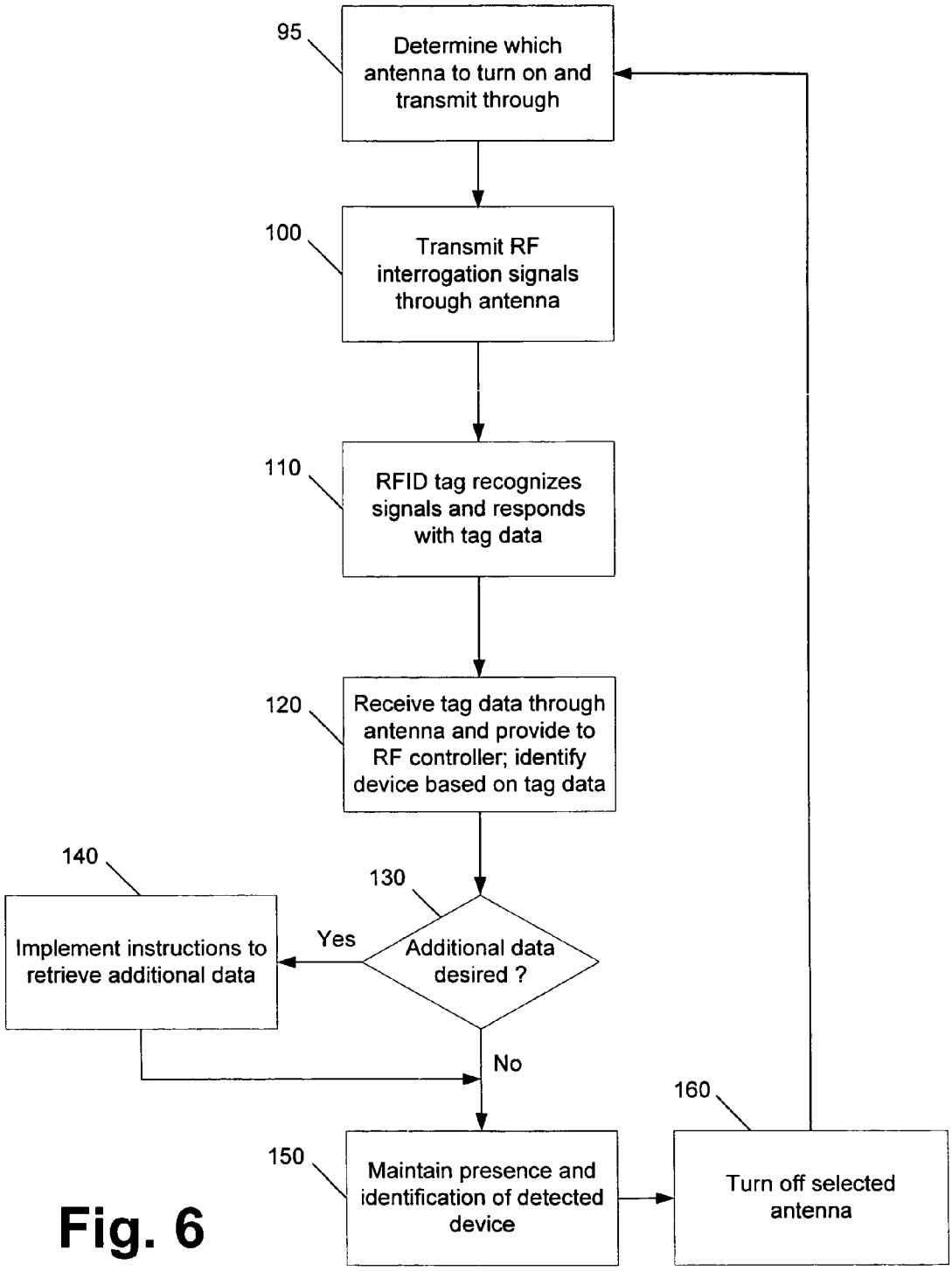
FIG. 6 is a flow diagram of another exemplary method of detecting the presence and determining the identification of devices in a rack in accordance with the present invention.

FIG. 5 is a block diagram of an exemplary rack system with another exemplary antenna in accordance with the present invention, and FIG. 6 is a flow diagram of an exemplary corresponding method of detecting the presence and determining the identification of devices in a rack. FIG. 5 contains elements similar to those described above with respect to FIG. 3, and FIG. 6 contains elements similar to those described above with respect to FIG. 4. These elements are labeled identically and their description is omitted for brevity.

In FIG. 5, a multiplexed antenna (comprising antennae 305, 310, 330, 340) replaces the antenna 230 of FIG. 3. A pod unit 320 is coupled to the power supply 109 via an electrical connection 302, and is also coupled to the antennae. Such a plurality of antennae could be used to determine the location of the devices 105, 107, etc. in the rack. Each antenna 305, 310, 330, 340 is disposed to read a particular portion of the rack, each portion desirably corresponding to a single device. The pod unit 320 determines which antenna to activate (to issue interrogate signals and receive presence signals in response) and in what order. For example, the antenna 305 at the bottom of the rack 100 could be turned on, and the tag 211 would then be detected and read. The antenna 305 would be turned off, and the next higher antenna in the rack 100 (e.g., the antenna 310) would be turned on, and the tag 210 would be detected and read. In this manner, the relative stacking order of the devices in the rack may be determined (e.g., the server 105 resides above the networking switch 107 in the rack 100).

More particularly, with respect to FIG. 6, the pod unit determines which antenna to turn on, at step 95. The selected antenna is turned on and broadcasts interrogating signals, at step 100. Processing continues as set forth above with respect to FIG. 4 until the device associated with the selected antenna is detected and identified. The pod unit then turns off the selected antenna at step 160, and processing continues at step 95, with another antenna selected to be turned on. Desirably, the antenna set is cycled through, repeatedly, to detect and identify the devices that may be in the rack. This information can then be used to determine the stacking order of the devices in the rack.

Desirably, each antenna 305, 310, 330, 340, has an active portion and a shielded portion. The shielded portion is that portion of the antenna that runs from the pod unit 320 to the device (represented in FIG. 5 as the dashed portion of the antenna 350). The active portion is preferably a portion that surrounds the area where a device would be (represented in FIG. 5 as the solid portion of the antenna 352). In this manner, each antenna will be capable of detecting the presence of only the device in the rack that is associated with the antenna (and detectable in the active portion), and be prevented from detecting the presence of other devices in the rack or elsewhere (e.g., in neighboring racks in the vicinity). Elements 332 and 342 represent exemplary devices that may be present in the rack.

According to an embodiment of the invention, a list of the devices in the rack that have been detected and identified is maintained in storage, such as storage that is local or remote to the pod unit and/or the central controller, for example. The system then monitors the presence of these devices, e.g., for security purposes or theft detection/prevention. If a device that had been previously detected in the rack is no longer detected, the system preferably logs the absence of the device, and may notify a central authority or other user.

Figure 7:
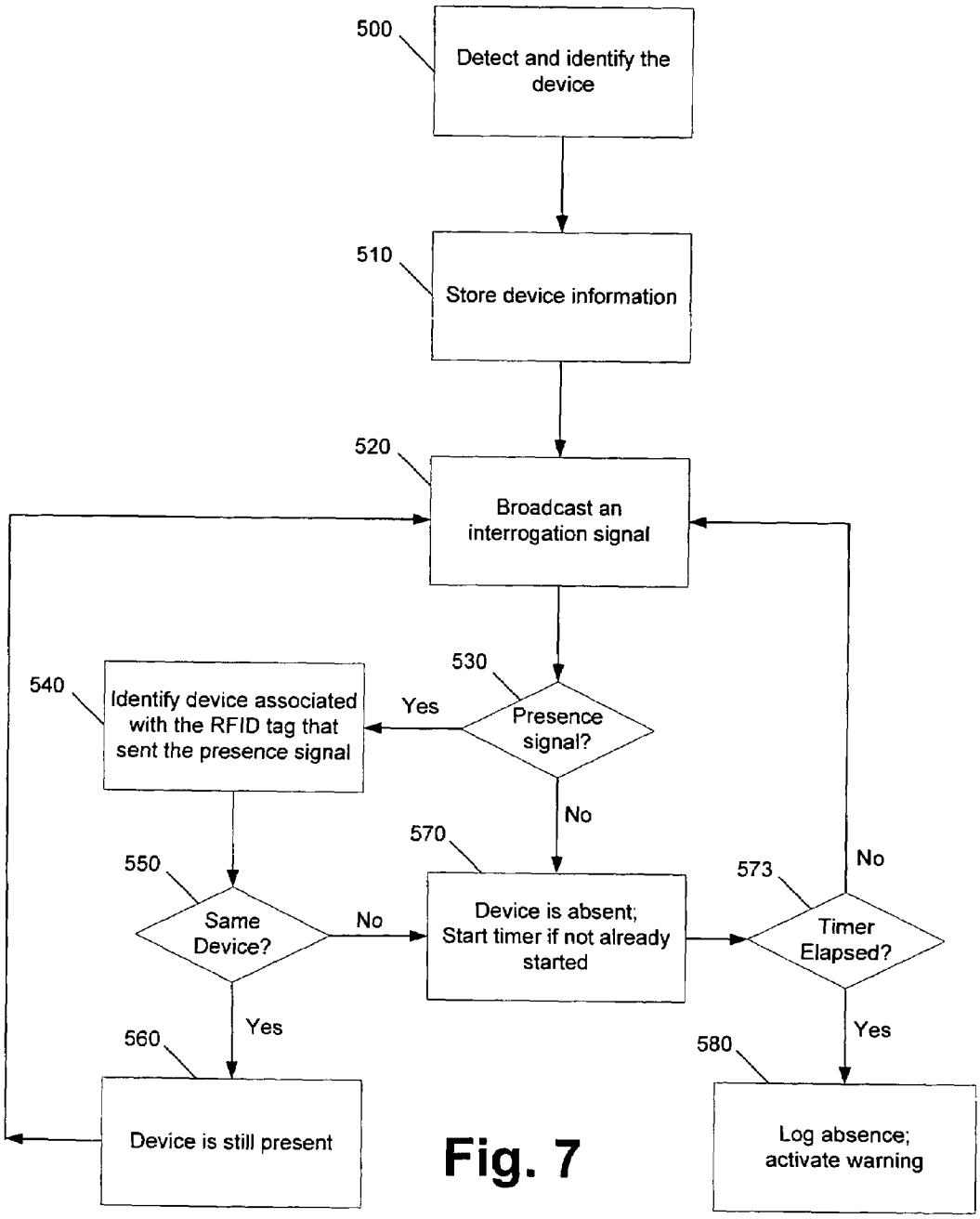
FIG. 7 is a flow diagram of an exemplary method of monitoring the presence of devices in a rack in accordance with the present invention.

FIG. 7 is a flow diagram of an exemplary method of monitoring the presence of devices in a rack in accordance with the present invention. At step 500, a device is detected and identified using RFID technology, such as that set forth above. The device information is stored, at step 510, in storage that is accessible to the pod unit and/or the central server. At some point, desirably periodically, an interrogation is signal is broadcast, at step 520.

It is then determined if the device that was earlier detected has responded to the latest interrogation signal with a presence signal via its RFID tag. This determination can be performed by receiving the presence signal, if any, from the RFID tag at step 530, and based on the information in the presence signal, determining the device to which the responding RFID tag is attached, at step 540. The latest device information is then compared to the previously stored device information, at step 550, to determine if the detected device is the same as previously identified. In such a case, it is determined that the originally detected device is still present, at step 560. Monitoring may then continue at step 520.

If, however, there is no response from the RFID tag associated with the earlier detected device, at step 570, it is determined that the device is no longer in the rack (or a different device is in the rack), and this absence may be noted in a log, for example, and a warning or other indicator may be activated, at step 580.

Additionally and optionally, if there is no response from the RFID tag associated with the earlier detected device at step 570, a timer is started. If a predetermined time elapses without the device's presence being detected again (repeating steps 520 to 570, and checking the timer at step 573), it is then determined that the device is no longer in the rack, and logging and/or warning about the absence may be implemented at step 580. If the predetermined time does not elapse before the device's presence is detected again, then the timer is reset, and monitoring may proceed at step 520.

The policies or rules that implement the monitoring of the devices could be stored at the desktop, for example, and may be determined by a user and/or by a central authority or administrator. The policies or rules desirably include such items as how often to send an interrogation signal to monitor the continued presence of a device, and how much time should elapse since the last detection of a presence signal from the device before determining that the device is missing and logging the absences and/or warning of the absence.

It is contemplated that collisions can occur, for example, when multiple RFID tags occupy the same RF channel. Accordingly, collision detection is preferably used to avoid or otherwise overcome the collisions between the data packets or signals of the variously transmitting RFID tags. For example, where collisions occur, repeat transmissions are desirably used until all the data packets are properly received.

Although the above embodiments have been described with respect to the RFID reader (detector system) residing in a rack, the RFID reader can be disposed separately from the rack, either in a standalone device or integrated into another piece of equipment that is connected to the rack, either through wired or wireless technologies.

Exemplary Computing Environment

Figure 8:
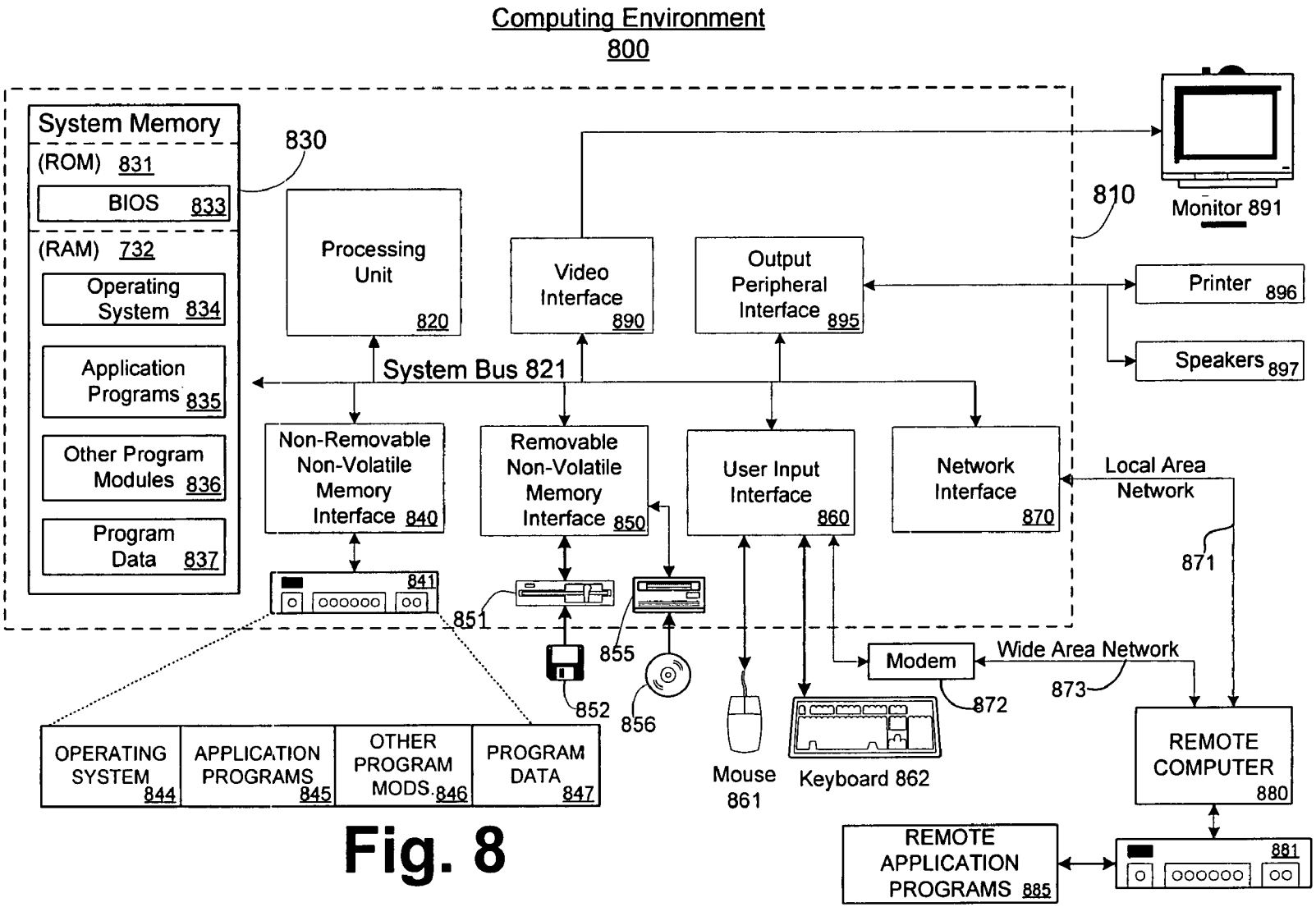
FIG. 8 is a block diagram showing an exemplary computing environment in which aspects of the invention may be implemented.

FIG. 8 illustrates an example of a suitable computing system environment 800 in which the invention may be implemented. The computing system environment 800 is only one example of a suitable computing environment and is not intended to suggest any limitation as to the scope of use or functionality of the invention. Neither should the computing environment 800 be interpreted as having any dependency or requirement relating to any one or combination of components illustrated in the exemplary operating environment 800.

The invention is operational with numerous other general purpose or special purpose computing system environments or configurations. Examples of well known computing systems, environments, and/or configurations that may be suitable for use with the invention include, but are not limited to, personal computers, server computers, hand-held or laptop devices, multiprocessor systems, microprocessor-based systems, set top boxes, programmable consumer electronics, network PCs, minicomputers, mainframe computers, distributed computing environments that include any of the above systems or devices, and the like.

The invention may be described in the general context of computer-executable instructions, such as program modules, being executed by a computer. Generally, program modules include routines, programs, objects, components, data structures, etc. that perform particular tasks or implement particular abstract data types. The invention may also be practiced in distributed computing environments where tasks are performed by remote processing devices that are linked through a communications network or other data transmission medium. In a distributed computing environment, program modules and other data may be located in both local and remote computer storage media including memory storage devices.

With reference to FIG. 8, an exemplary system for implementing the invention includes a general purpose computing device in the form of a computer 810. Components of computer 810 may include, but are not limited to, a processing unit 820, a system memory 830, and a system bus 821 that couples various system components including the system memory to the processing unit 820. The system bus 821 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus (also known as Mezzanine bus).

Computer 810 typically includes a variety of computer readable media. Computer readable media can be any available media that can be accessed by computer 810 and includes both volatile and non-volatile media, removable and non-removable media. By way of example, and not limitation, computer readable media may comprise computer storage media and communication media. Computer storage media includes both volatile and non-volatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can accessed by computer 810. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above should also be included within the scope of computer readable media.

The system memory 830 includes computer storage media in the form of volatile and/or non-volatile memory such as ROM 831 and RAM 832. A basic input/output system 833 (BIOS), containing the basic routines that help to transfer information between elements within computer 810, such as during start-up, is typically stored in ROM 831. RAM 832 typically contains data and/or program modules that are immediately accessible to and/or presently being operated on by processing unit 820. By way of example, and not limitation, FIG. 8 illustrates operating system 834, application programs 835, other program modules 836, and program data 837.

The computer 810 may also include other removable/non-removable, volatile/non-volatile computer storage media. By way of example only, FIG. 8 illustrates a hard disk drive 840 that reads from or writes to non-removable, non-volatile magnetic media, a magnetic disk drive 851 that reads from or writes to a removable, non-volatile magnetic disk 852, and an optical disk drive 855 that reads from or writes to a removable, non-volatile optical disk 856, such as a CD-ROM or other optical media. Other removable/non-removable, volatile/non-volatile computer storage media that can be used in the exemplary operating environment include, but are not limited to, magnetic tape cassettes, flash memory cards, digital versatile disks, digital video tape, solid state RAM, solid state ROM, and the like. The hard disk drive 841 is typically connected to the system bus 821 through a non-removable memory interface such as interface 840, and magnetic disk drive 851 and optical disk drive 855 are typically connected to the system bus 821 by a removable memory interface, such as interface 850.

The drives and their associated computer storage media provide storage of computer readable instructions, data structures, program modules and other data for the computer 810. In FIG. 8, for example, hard disk drive 841 is illustrated as storing operating system 844, application programs 845, other program modules 846, and program data 847. Note that these components can either be the same as or different from operating system 834, application programs 835, other program modules 836, and program data 837. Operating system 844, application programs 845, other program modules 846, and program data 847 are given different numbers here to illustrate that, at a minimum, they are different copies. A user may enter commands and information into the computer 810 through input devices such as a keyboard 862 and pointing device 861, commonly referred to as a mouse, trackball or touch pad. Other input devices (not shown) may include a microphone, joystick, game pad, satellite dish, scanner, or the like. These and other input devices are often connected to the processing unit 820 through a user input interface 860 that is coupled to the system bus, but may be connected by other interface and bus structures, such as a parallel port, game port or a universal serial bus (USB). A monitor 891 or other type of display device is also connected to the system bus 821 via an interface, such as a video interface 890. In addition to the monitor, computers may also include other peripheral output devices such as speakers 897 and printer 896, which may be connected through an output peripheral interface 895.

The computer 810 may operate in a networked environment using logical connections to one or more remote computers, such as a remote computer 880. The remote computer 880 may be a personal computer, a server, a router, a network PC, a peer device or other common network node, and typically includes many or all of the elements described above relative to the computer 810, although only a memory storage device 881 has been illustrated in FIG. 8. The logical connections depicted include a LAN 871 and a WAN 873, but may also include other networks. Such networking environments are commonplace in offices, enterprise-wide computer networks, intranets and the internet.

When used in a LAN networking environment, the computer 810 is connected to the LAN 871 through a network interface or adapter 870. When used in a WAN networking environment, the computer 810 typically includes a modem 872 or other means for establishing communications over the WAN 873, such as the internet. The modem 872, which may be internal or external, may be connected to the system bus 821 via the user input interface 860, or other appropriate mechanism. In a networked environment, program modules depicted relative to the computer 810, or portions thereof, may be stored in the remote memory storage device. By way of example, and not limitation, FIG. 8 illustrates remote application programs 885 as residing on memory device 881. It will be appreciated that the network connections shown are exemplary and other means of establishing a communications link between the computers may be used.

As mentioned above, while exemplary embodiments of the present invention have been described in connection with various computing devices, the underlying concepts may be applied to any computing device or system.

The various techniques described herein may be implemented in connection with hardware or software or, where appropriate, with a combination of both. Thus, the methods and apparatus of the present invention, or certain aspects or portions thereof, may take the form of program code (i.e., instructions) embodied in tangible media, such as floppy diskettes, CD-ROMs, hard drives, or any other machine-readable storage medium, wherein, when the program code is loaded into and executed by a machine, such as a computer, the machine becomes an apparatus for practicing the invention. In the case of program code execution on programmable computers, the computing device will generally include a processor, a storage medium readable by the processor (including volatile and non-volatile memory and/or storage elements), at least one input device, and at least one output device. The program(s) can be implemented in assembly or machine language, if desired. In any case, the language may be a compiled or interpreted language, and combined with hardware implementations.

The methods and apparatus of the present invention may also be practiced via communications embodied in the form of program code that is transmitted over some transmission medium, such as over electrical wiring or cabling, through fiber optics, or via any other form of transmission, wherein, when the program code is received and loaded into and executed by a machine, such as an EPROM, a gate array, a programmable logic device (PLD), a client computer, or the like, the machine becomes an apparatus for practicing the invention. When implemented on a general-purpose processor, the program code combines with the processor to provide a unique apparatus that operates to invoke the functionality of the present invention. Additionally, any storage techniques used in connection with the present invention may invariably be a combination of hardware and software.

While the present invention has been described in connection with the preferred embodiments of the various figures, it is to be understood that other similar embodiments may be used or modifications and additions may be made to the described embodiments for performing the same function of the present invention without deviating therefrom. Therefore, the present invention should not be limited to any single embodiment, but rather should be construed in breadth and scope in accordance with the appended claims.

What is claimed is:

1. A system for determining presence of a device, comprising:

a radio frequency identification (RFID) tag disposed on the device; and a rack in which the device is maintained, the rack comprising:

an antenna adapted to transmit interrogation signals to the RFID tag, and receive presence signals from the RFID tag; and a presence and occupancy discovery (pod) unit comprising an RF interrogator and an RF controller, the pod unit adapted to receive and decode the presence signals from the antenna, and to determine the presence of the device in the rack based on the decoded presence signals, and to monitor the continued presence of the device in the rack by directing interrogation signals to be transmitted via the antenna at predetermined times and confirming detection of received presence signals from the device, wherein if a presence signal is not received from the device, the pod unit starts a timer, and if the timer elapses before another presence signal is received from the device, at least one of an indicator is activated, an absence entry is logged in storage, and a warning signal is provided to a central controller.

2. The system of claim 1, further comprising a central controller remote from the rack and adapted to receive the presence signals from the pod unit and provide information about the device in response to the presence signals.

3. The system of claim 2, further comprising a storage device connected to the central controller comprising identification information, the central controller accessing the storage device and retrieving the identification information based on the decoded presence signals.

4. The system of claim 1, wherein the rack is capable of receiving a plurality of devices, and the antenna is disposed along the height of the rack to transmit interrogation signals to each of the devices.

5. The system of claim 1, wherein the rack is capable of receiving a plurality of devices, and the antenna comprises a plurality of antennae, each of the plurality of antennae corresponding to an associated one of the devices to transmit interrogation signals individually to each of the devices.

6. The system of claim 1, wherein the pod unit is further adapted to identify the device based on the decoded presence signals.

7. The system of claim 6, further comprising a storage device connected to the pod unit comprising identification information, the pod unit accessing the storage device and retrieving the identification information based on the decoded presence signals.

8. The system of claim 1, wherein the timer is programmable via the rack or a central controller.

9. The system of claim 1, wherein the decoded presence signals comprise identification information associated with the device.

10. The system of claim 1, wherein the pod unit is adapted to receive presence signals from a plurality of RFID tags associated with a plurality of devices, identify the devices associated with the RFID tag based on the received presence signals, and monitor the presence of the identified devices.

11. A method for determining presence of a device in a rack, comprising:

receiving a presence signal from at least one radio frequency identification (RFID) tag at a detector comprising an RF controller, the RFID tag disposed on the device, the device maintained in the rack;

decoding the presence signals at a presence and occupancy discovery (pod) unit associated with the rack;

determining the presence of the device in the rack based on the decoded presence signals; and monitoring the continued presence of the device in the rack by transmitting interrogation signals towards the device at predetermined times and confirming detection of received presence signals from the device, and if a presence signal is not received from the device, starting a timer, and if the timer elapses before another presence signal is received from the device, at least one of activating an indicator, logging an absence entry, and providing a warning signal.

12. The method of claim 11, further comprising providing the presence signals to a central controller remote from the rack, and retrieving information about the device in response to the presence signals.

13. The method of claim 11, further comprising accessing a storage device and retrieving identification information based on the decoded presence signals from the storage device.

14. The method of claim 11, further comprising receiving presence signals from a plurality of devices via an antenna disposed along the height of the rack.

15. The method of claim 11, further comprising receiving presence signals from a plurality of devices via a plurality of antennae, each of the plurality of antennae corresponding to an associated one of the devices.

16. The method of claim 11, further comprising identifying the device based on the decoded presence signals.

17. The method of claim 11, wherein the decoded presence signals comprise identification information associated with the device.

18. The method of claim 11, further comprising receiving presence signals from a plurality of RFID tags associated with a plurality of devices, identifying the devices associated with the RFID tag based on the received presence signals, and monitoring the presence of the identified devices.

* * * * *